US005425662A

United States Patent [19]

Villeneuve: Gary L.

[11] Patent Number: 5,425,662

[45] Date of Patent: Jun. 20, 1995

[54] CRIMPED WIRE TERMINAL WITH MECHANICAL LOCKING

[75] Inventor: Villeneuve: Gary L., Woodhaven, Mich.

[73] Assignee: Ford Motor Company, Dearborn, Mich.

[21] Appl. No.: 312,494

[22] Filed: Sep. 26, 1994

Related U.S. Application Data

[63] Continuation of Ser. No. 43,085, Apr. 5, 1993, abandoned.

[51] Int. Cl.[6] ..... H01R 4/18

[52] U.S. Cl. ..... 439/882

[58] Field of Search ..... 439/877-882, 439/865-868

[56] References Cited

U.S. PATENT DOCUMENTS

| | | | |
|---|---|---|---|
| 2,821,011 | 1/1958 | Sanders et al. | 29/155.55 |
| 2,992,404 | 7/1961 | Berg | 439/882 |
| 3,137,925 | 6/1964 | Wahl | 29/155.55 |
| 3,387,080 | 6/1968 | Dibble et al. | 174/94 |
| 3,735,331 | 5/1973 | O'Donnell et al. | 439/882 |
| 3,761,872 | 9/1973 | Ebinger | 439/882 |
| 3,889,048 | 6/1975 | Groth | 174/94 R |
| 3,990,143 | 11/1976 | Dittmann et al. | 29/628 |
| 4,165,148 | 8/1979 | Campbell et al. | 439/880 |
| 4,692,122 | 9/1987 | Montalbano | 439/882 |
| 4,815,200 | 3/1989 | Ito | 29/857 |

FOREIGN PATENT DOCUMENTS

| | | |
|---|---|---|
| 1515399 | 11/1962 | Germany . |
| 813160 | 8/1957 | United Kingdom . |
| 2041794 | 9/1980 | United Kingdom . |

*Primary Examiner*—Gary F. Paumen

*Attorney, Agent, or Firm*—Mark Mollon; Roger L. May

[57] ABSTRACT

A terminal is attached to a multiconductor wire by crimping of a pair of conductor grips around the conductors. Mechanical locking of the conductor grips maintains a firm grasp of the conductors for improved low current and/or low voltage performance. Mechanical locking is obtained using grooves within the contact areas of the conductor grips.

10 Claims, 3 Drawing Sheets

CRIMPED WIRE TERMINAL WITH MECHANICAL LOCKING

This is a continuation of application Ser. No. 08/043,085 filed Apr. 5, 1993, now abandoned.

BACKGROUND OF THE INVENTION

The present invention relates in general to an electrical terminal permanently attached to the end of an insulated wire, and more specifically to crimped wire terminals for low current and low voltage applications.

Crimped terminals are widely used for terminating multiconductor insulated wires. The terminal comprises a flat metal blank including pairs of wing projections for gripping an electrical wire. One pair of projections grips an insulated portion of the wire and another pair of projections grips a stripped conductor portion at the end of the wire. The insulator grips stabilize the terminal and protect the electrical interconnection between the stripped conductor and the conductor grips.

Nevertheless, in-use conditions experienced by a terminal (such as flexing of the wire, vibration and thermal shocks, or jostling of the terminal) cause forces to be transmitted to the conductor grips. Over time, the conductor grip may weaken and begin to move.

Conductor grip weakening is especially a problem in low current and low voltage applications where continuous, firm contact between the wire strands and the conductor grips is critical. A weakened conductor grip may cause increased resistance or intermittent contact, which is most likely to occur at low current or low voltage levels.

SUMMARY OF THE INVENTION

The present invention achieves improved conductor grip performance by providing mechanical locking of the crimped conductor grips resulting in a more rigid attachment. More specifically, the invention provides a crimped-type terminal for crimping around a multiconductor wire oriented along an axis. The crimped terminal is adapted to be joined with a mating-terminal of an electrical device or a connecting wire. The crimped terminal has a terminal body comprising a metal blank having a substantially flat central blank portion. An insulator grip extends from one end of the central blank portion substantially perpendicularly to the axis for gripping an insulated portion of the multiconductor wire. Interconnect means are formed at the other end of the central blank portion for interconnecting with the mating terminal of the electrical device. A pair of conductor grips extends from the central blank portion between the insulator grip and the inner connect means and substantially perpendicular to the axis. The conductor grips have first sides for contacting an uninsulated portion of the multiconductor wire after crimping. The second sides of the conductor grips abut at respective contact areas and include interlock means for engaging during crimping to decrease movement of the conductor grips after crimping. Preferably, the interlock means comprise respective grooves in the respective contact areas which are substantially perpendicular to the axis.

DETAILED DESCRIPTION OF PREFERRED EMBODIMENT

Figure 1:
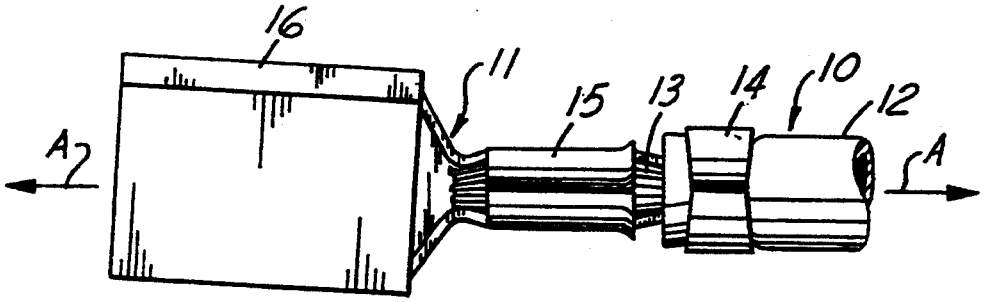
FIG-1 PRIOR ART
FIG. 1 is a plan view of a conventional crimp-type terminal.

As shown in FIG. 1, a multiconductor wire 10 is joined to a terminal 11. Multiconductor wire 10 includes an insulation covering 12 containing wire strands 13. Terminal 11 includes insulator grips 14 for gripping insulation 12 and conductor grips 15 for gripping strands 13. By crimping conductor grips 15 around wire strands 13, a cavity is formed which firmly retains wire strands 13 providing electrical continuity with terminal 11.

Terminal 11 further includes connection means such as a box-type connector 16 for interconnecting with the mating terminal such as a blade terminal of an electrical device or another connection wire.

Figure 2:
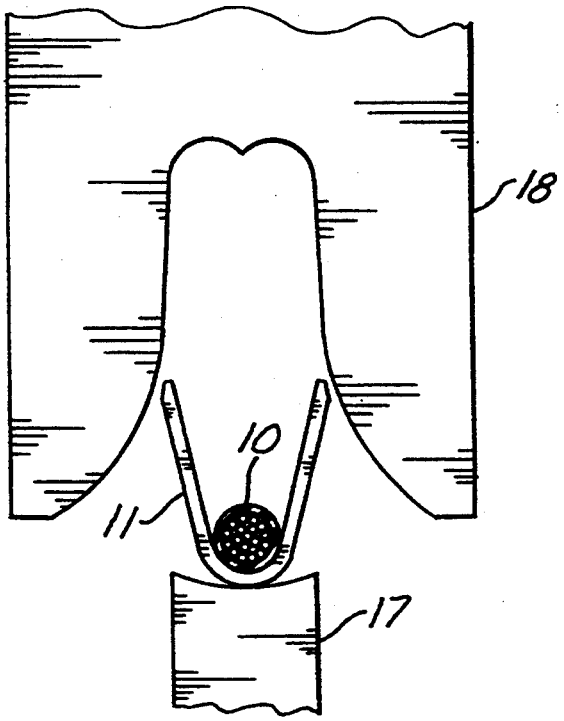
FIG. 2 is a diagrammatic view showing conventional tooling used in the crimping of a terminal.
Figure 3:
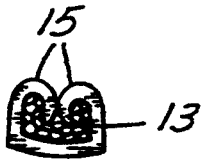
FIG. 3 is a cross-sectional view showing a conventional terminal after crimping.

Insulator grip 14 and conductor grips 15 grasp multiconductor wire 10 as a result of crimping. As shown in FIG. 2, multiconductor wire strands 13 are laid within terminal 11 and the two are then placed on an anvil 17 with the conductor grips located below a punch 18. During crimping, punch 18 and anvil 17 are quickly brought together. An upper curved surface within punch 18 crimps the grips of terminal 11 onto multiconductor wire strands 13. As shown in FIG. 3, wire strands 13 are tightly retained within conductor grips 15 after crimping. Nevertheless, subsequent flexing of the multiconductor wire and other forces applied to conductor grips 15 can eventually result in a weakened connection and relative motion.

Figure 4:
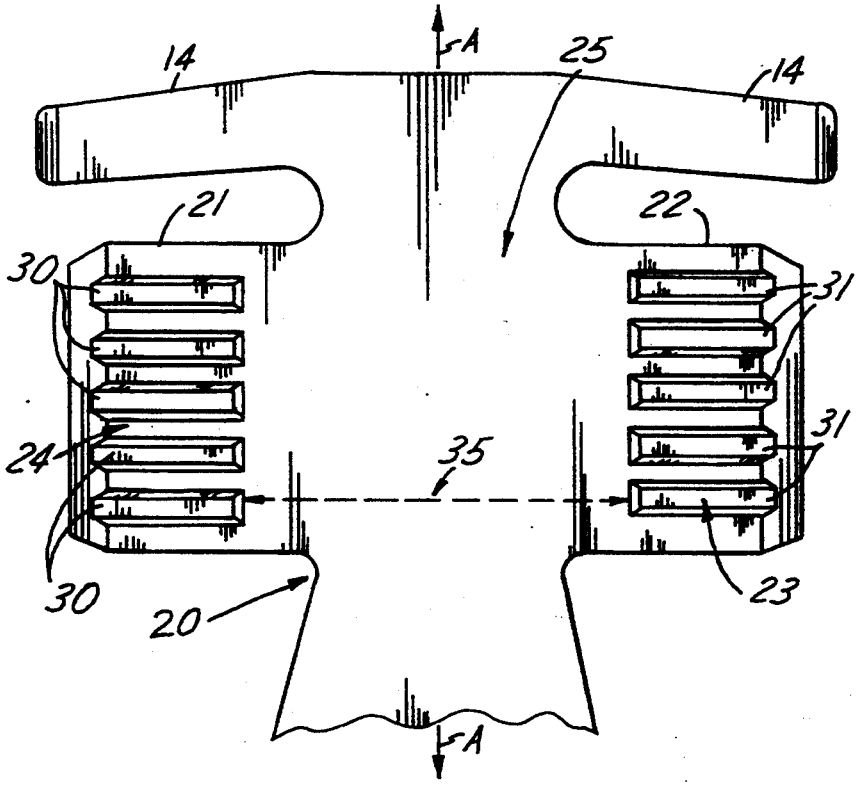
FIG. 4 is a partial bottom view showing a flat blank according to the present invention.

An improved connection is obtained using a terminal body 20 shown in FIG. 4 which is formed from a flat, conductive metal blank. Insulator grips 14 extend from a central blank portion 25 substantially perpendicularly to longitudinal axis A of terminal body 20. Likewise, a conductor grip 21 and a conductor grip 22 extend from central blank portion 25 substantially perpendicularly to longitudinal axis A.

FIG. 4 is a bottom view of terminal body 20, i.e., opposite from the side which receives the multiconductor wire. On the bottom surface of conductor grips 21 and 22, a pair of contact areas 23 and 24 come into contact after crimping. According to the present invention, a plurality of grooves 30 are provided in conductor grip 21 and a plurality of grooves 31 are provided in conductor grip 22 such that grooves 30 and 31 pass through contact areas 23 and 24 in a direction perpendicular to longitudinal axis A. The ends of insulator grips 14 and conductor grips 21 and 22 are coined to facilitate crimping as is known in the art.

Figure 5:
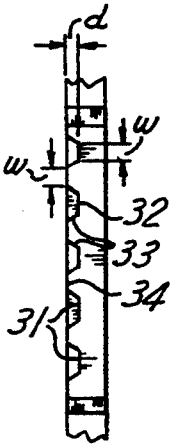
FIG. 5 is a side view of the blank shown in FIG. 4.

FIG. 5 is a side view of conductor grip 22. Grooves 31 have a depth "d" approximately equal to one-third the total width of conductor grip 22. Each groove 30 and 31 consists of a channel which may be stamped or otherwise formed in the terminal body. Each groove has a bottom surface 32 and side surfaces 33 sloping up to an intermediate surface 34. Bottom surfaces 32 and intermediate surfaces 34 all have a width "w" to facilitate interlocking of the grooves as will be described below.

Figure 6:
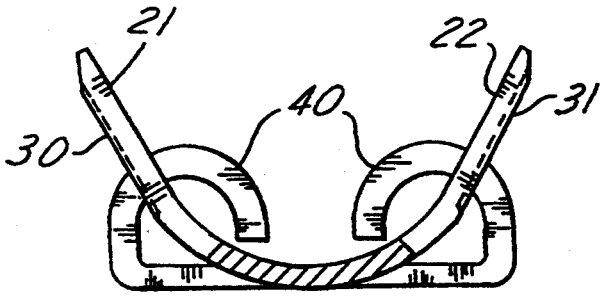
FIG. 6 is a cross-sectional view of a terminal according to the present invention prior to crimping.

The terminal body of FIG. 4 can be formed by any known process, such as by stamping. Respective grooves 30 and 31 are colinear as shown by line 35. After formation of the flat terminal body, insulator grips 14 and conductor grips 21 and 22 are bent upward for the crimping process, for example, by rolling, such that grooves 30 and 31 are on the outside surface as shown in FIG. 6. Interconnect means, such as socket 40 for a slip-on terminal, are formed by any suitable method. Any other interconnect means may alternatively be employed in the present invention, such as eyelets.

Figure 7:
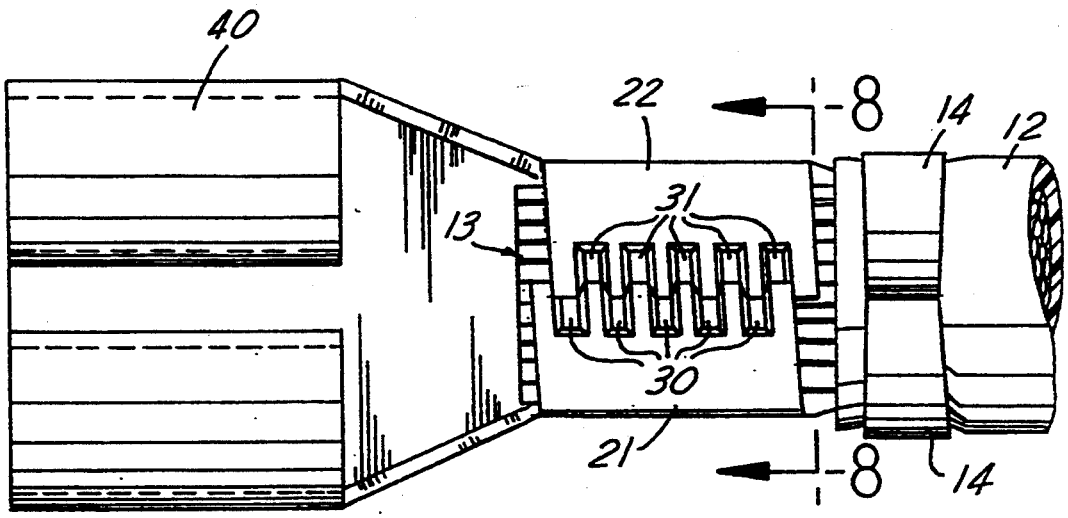
FIG. 7 is a plan view of a crimped terminal according to the present invention.
Figure 8:
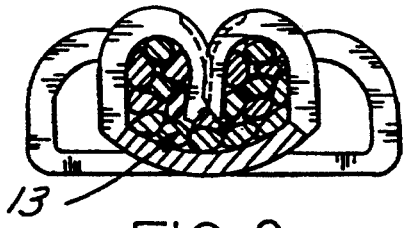
FIG. 8 is a cross-sectional view of the terminal of FIG. 7 after crimping, taken along lines 8—8 of FIG. 7.

FIG. 7 shows a completed terminal after crimping. During crimping of conductor grips 21 and 22, grooves 30 become interlocked with grooves 31, i.e., conductor grips 21 and 22 shift axially to permit the nesting of the grooves. After crimping, the nested grooves provide mechanical locking which prevents movement of the conductor grips thereby maintaining the grasping force on conductors 13. As shown in FIG. 8, conductors 13 are firmly held against the conductor body. The mechanical interlocking of grooves 30 and 31 insures that the firm contact is maintained over time.

Figure 9:
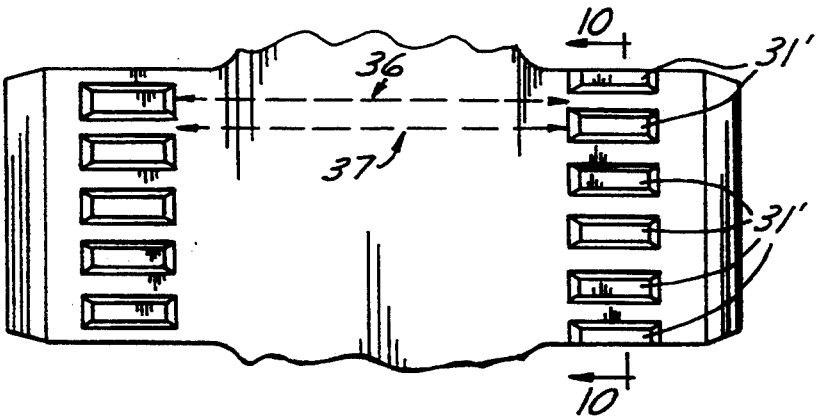
FIG. 9 is a partial bottom view of an alternative embodiment of the conductor grips of the present invention.
Figure 10:
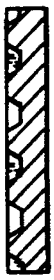
FIG. 10 is a side cross-sectional view of the conductor grip along lines 10—10 of FIG. 9.

FIG. 9 shows an alternative embodiment wherein grooves 31' are offset from grooves 30. As shown by lines 36 and 37, the respective grooves are interleaved when the grooves are first formed in the terminal body. Once again, the grooves are comprised of channels that may be stamped or otherwise formed in the terminal body. In this embodiment, grooves 31' do not extend all the way to the coined ends of conductor grips 21 and 22, thereby reducing wear on the surfaces of the crimping tools (i.e., punch) that would otherwise be caused by the groove edges at the coined ends.

What is claimed is:

1. A crimp-type terminal for crimping around a multiconductor wire oriented along an axis and for joining with a mating terminal of an electrical device, said terminal having a terminal body comprising:

a flat blank having a central blank portion;

an insulator grip extending from one end of said central blank portion substantially perpendicularly to said axis for gripping an insulated portion of said multiconductor wire;

interconnect means formed at the other end of said central blank portion for interconnecting with said mating terminal; and first and second conductor grips extending on opposite sides of said central blank portion between said insulator grip and said interconnect means and substantially perpendicularly to said axis, said first and second conductor grips each having a top surface for contacting an uninsulated portion of said multiconductor wire after crimping, said conductor grips each having a bottom surface coming into abutment with the other bottom surface at respective contact areas during crimping, said conductor grips including interlocking grooves in said contact areas of said bottom surfaces for engaging during crimping to reduce movement of said conductor grips after crimping.

2. The terminal of claim 1 wherein said interlocking grooves are substantially perpendicular to said axis.

3. The terminal of claim 2 wherein said grooves are comprised of channels formed in said conductor grips.

4. The terminal of claim 2 wherein respective interlocking grooves on said first conductor grip are colinear with respective interlocking grooves on said second conductor grip prior to crimping.

5. The terminal of claim 2 wherein respective interlocking grooves on said first conductor grip are interleaved with respective interlocking grooves on said second conductor grip prior to crimping.

6. An electrical interconnection system comprising:

an insulated multiconductor wire having an axis and having insulation removed from its end; and a crimp-type terminal body crimped to said multiconductor wire for joining with a mating terminal of an electrical device, said terminal body comprised of:

a flat blank having a central blank portion;

an insulator grip extending from one end of said central blank portion substantially perpendicularly to said axis for gripping an insulated portion of said multiconductor wire;

interconnect means formed at the other end of said central blank portion for interconnecting with said mating terminal; and first and Second conductor grips extending on opposite sides of said central blank portion between said insulator grip and said interconnect means and substantially perpendicularly to said axis, said first and second conductor grips each having a top surface for contacting an uninsulated portion of said multiconductor wire after crimping, said conductor grips having bottom surfaces coming into abutment at respective contact areas during crimping, said conductor grips including interlocking grooves in said contact areas of said bottom surfaces for engaging during crimping to reduce movement of said conductor grips after crimping.

7. The interconnection system of claim 6 wherein said interlocking grooves are substantially perpendicular to said axis.

8. The interconnection system of claim 7 wherein said interlocking grooves are comprised of channels formed in said bottom surfaces of said conductor grips.

9. The interconnection system of claim 7 wherein respective interlocking grooves on said first conductor grip are colinear with respective interlocking grooves on said second conductor grip prior to crimping.

10. The interconnection system of claim 7 wherein respective interlocking grooves on said first conductor grip are interleaved with respective interlocking grooves on said second conductor grip prior to crimping.

* * * * *